US007802739B2

(12) United States Patent
Scorvo et al.

(10) Patent No.: US 7,802,739 B2
(45) Date of Patent: Sep. 28, 2010

(54) MANUALLY OPERABLE DRAIN DEVICE

(76) Inventors: Sean K. Scorvo, 1525 NE. Fremont, Portland, OR (US) 97212; David A. Strayer, 11350 SW. Clifford St., Beaverton, OR (US) 97008

( * ) Notice: Subject to any disclaimer, the term of this patent is extended or adjusted under 35 U.S.C. 154(b) by 378 days.

(21) Appl. No.: 11/800,221

(22) Filed: May 4, 2007

(65) Prior Publication Data

US 2007/0290082 A1 Dec. 20, 2007

Related U.S. Application Data

(60) Provisional application No. 60/814,409, filed on Jun. 15, 2006, provisional application No. 60/814,495, filed on Jun. 15, 2006, provisional application No. 60/814,497, filed on Jun. 15, 2006, provisional application No. 60/855,577, filed on Oct. 30, 2006, provisional application No. 60/873,657, filed on Dec. 8, 2006.

(51) Int. Cl.
*B02C 19/00* (2006.01)

(52) U.S. Cl. ..... 241/21; 241/46.013; 241/46.017

(58) Field of Classification Search ..... 241/21, 241/46.013–46.017
See application file for complete search history.

(56) References Cited

U.S. PATENT DOCUMENTS

| | | | |
|---|---|---|---|
| 1,434,066 | A | 10/1922 | Rodgers |
| 1,614,358 | A | 1/1927 | Gandillon |
| 1,720,149 | A | 7/1929 | Rom |
| 2,012,680 | A | 8/1935 | Hammes |
| 2,479,485 | A | 8/1949 | Frank |
| 2,583,997 | A | 1/1952 | Chester |
| 2,886,254 | A | 5/1959 | Rohlinger et al. |
| 2,935,992 | A | 5/1960 | Barker et al. |
| 3,403,865 | A | 10/1968 | Guth et al. |
| 3,439,878 | A | 4/1969 | Reaux |
| 3,813,708 | A | 6/1974 | Hamburg |
| 4,183,470 | A | 1/1980 | Hovartos et al. |
| 4,271,540 | A | 6/1981 | Clifton |
| 4,309,823 | A | 1/1982 | Antolino et al. |
| 4,549,352 | A | 10/1985 | Ochiai et al. |
| 4,807,306 | A | 2/1989 | Hayman et al. |
| 4,902,412 | A | 2/1990 | Surber, III et al. |
| 5,003,642 | A | 4/1991 | Robb et al. |
| 5,022,153 | A | 6/1991 | Baron |
| 5,141,166 | A | 8/1992 | Maynard, Jr. |
| 5,271,571 | A | 12/1993 | Maynard, Jr. |
| 5,413,705 | A | 5/1995 | Tammera et al. |
| 5,901,446 | A | 5/1999 | Szymansky |
| 5,964,038 | A | 10/1999 | DeVito |
| 6,263,518 | B1 | 7/2001 | Magtanong |
| 7,467,754 | B2 * | 12/2008 | McCambridge et al. ..... 241/2 |

* cited by examiner

*Primary Examiner*—Mark Rosenbaum
(74) *Attorney, Agent, or Firm*—Bullivant Houser Bailey

(57) ABSTRACT

A manually operable device and a method for separating solid waste materials from liquid to be disposed of through a drain, and for reducing the size of pieces of such solid waste materials for more efficient disposal through the drain. A size reduction assembly is manually movable with respect to a stationary body and may include perforated material for catching solid material from a liquid flowing into the drain, and at least one cutting or ripping or abrasion component for reducing the size of pieces of the solid material into smaller pieces that may then pass downward through the drain. In some embodiments the size reduction assembly may be driven downward by pressure from a hand or foot. The reduced-size pieces of material are flushed from the device by liquid draining through the device.

49 Claims, 8 Drawing Sheets

MANUALLY OPERABLE DRAIN DEVICE

CROSS-REFERENCE TO RELATED APPLICATIONS

This application claims the benefit of U.S. Provisional Patent Applications Nos. 60/814,409, filed Jun. 15, 2006; 60/814,495, filed Jun. 15, 2006; 60/814,497, filed Jun. 15, 2006; 60/855,577, filed Oct. 30, 2006; and 60/873,657, filed Dec. 8, 2006.

BACKGROUND

The present invention relates to a device for handling solid materials such as hair, to reduce clogging of household sink, tub, and shower drains. More particularly, the present invention relates to a manually operable device for reducing the size of pieces of hair and other solid waste materials to smaller pieces less likely to accumulate and clog a drain.

Drain receptacles for sinks, showers, and bath tubs frequently have strainers and filters covering or sitting in their openings so as to prevent solid materials from entering the drain conduit and clogging it at a downstream location. Such strainers are intended to allow liquid to pass while stopping the solid materials. However, in order for such devices to perform satisfactorily, they must be regularly cleaned, because they are prone to clogging. Cleaning such devices typically requires manually grabbing and removing the bacteria laden obstructing material, which often includes entwined human hair.

Sinks in food preparation areas typically have devices for comminuting solid waste in order to allow its passage into a connected drain without clogging it. These devices are usually electrically powered "garbage disposals" that have little need for manual cleaning and operation, although they require significant space for installation, electrical power for operation, and adequate access for maintenance. These requirements are difficult or impossible to meet in the typical shower, tub, or sink outside the kitchen area.

Previous attempts to provide various manually operable drain strainers, waste traps, and comminuting devices, including comminuting or shearing devices designed to cut human hair, have not been particularly successful.

For example, Gandillon U.S. Pat. No. 1,614,358 describes a manually operated device fitted under a common sink outlet, but the apparatus is prone to clogging, complex, and undesirably large. Comminution of solid material using such device is via manual rotation of a cone about a central axis against fixed blades.

Hammes U.S. Pat. No. 2,012,680 describes an early incarnation of the electric garbage disposal, flushing appropriately comminuted solid material from a grinding chamber by draining liquids through the chamber, and is shown as an under-sink installation.

Frank U.S. Pat. No. 2,479,485 shows a manually operated self-cleaning sink stopper, and addresses manual operation with solid waste straining and cutting functions. However, an initial strainer is included, to keep commonly encountered material from ever reaching a cutting surface and the initial strainer requires manual cleaning of materials trapped at that level. Furthermore, the device is prone to fouling with hair.

Hovartos, et al. U.S. Pat. No. 4,183,470 describes a garbage disposer that is driven by a water jet. The device requires significant space for installation and maintenance and has a vertically oriented shaft that is prone to fouling with hair. The device does not allow for manual operation when water flow provides insufficient power.

Maynard, Jr., U.S. Pat. No. 5,271,571 describes a water driven device for agitating and fragmenting debris in a sink drain. The device includes a hydraulically driven impeller that may also be manually engaged with the strainer basket. However, the central shaft is exposed to solid waste entering the drain, and is, therefore, prone to fouling.

Maynard, Jr., U.S. Pat. No. 5,141,166 discloses a device that includes a centrally mounted rotor which rotates within a sink drain. However, the device is actuated by linear strokes of a steeply pitched threaded rod passing through a threaded bore of a rotor, and the threaded rod is exposed to solid waste material and is therefore prone to fouling.

Other devices, such as electric razors that are designed specifically to cut hair, are not easily adapted for use in handling hair caught on sink, tub, or shower drain parts to prevent clogging of those drains. Ochiai, et al. U.S. Pat. No. 4,549,352 and Szymansky U.S. Pat. No. 5,901,446 describe cutting devices used in common electric shavers, but hair that has caught in sink, tub, or shower drains tends to be unlikely to be oriented so that these devices would be effective.

What is needed, therefore, is a device that is easily mounted in or constructed to fit in the space conventionally available in the strainer bowl or similar initial receptacle portion of a household drain, or constructed to replace such a strainer bowl or similar receptacle, for reducing the size of pieces of hair and other solid waste materials that might otherwise accumulate in and clog a drain conduit from household sink, tub, and shower drains, so as to promote more efficient disposal of the waste through the drain. Such a device should be manually operable with minimal physical effort of the operator, and resistant to clogs without needing frequent cleaning beyond that resulting from the operation of the device.

SUMMARY OF THE INVENTION

The present disclosure sets forth a description of a manually operable apparatus and a method for separating larger pieces of materials such as human hair, textile fibers, bits of grass or other vegetation, fingernails, toenails, and other waste materials from a flow of water being drained from a conventional fixture such as a bathtub, shower, or sink, and for periodically reducing the size of such accumulated pieces of waste materials to a size small enough to be flushed readily down through an ordinary drain conduit without accumulating readily in quantities able to cause a significant blockage of such a drain conduit.

In some embodiments the device is easily installed in an existing drain. Other embodiments may be manufactured as integral parts of drain receptacles to be mounted in a sink, tub, or shower.

The simplicity of the drain mounted device allows for easy production and installation, garnering significant advantages over more complex mechanisms such as motor-driven garbage disposals. The straining of waste at a location above the drain receptacle in some embodiments results in lower likelihood of drain stoppage than in other devices that collect strained waste in a chamber or basket structure.

The foregoing and other objectives, features, and advantages of the invention will be more readily understood upon consideration of the following detailed description of the invention taken in conjunction with the accompanying drawings.

DETAILED DESCRIPTION OF EMBODIMENTS

Figure 1:
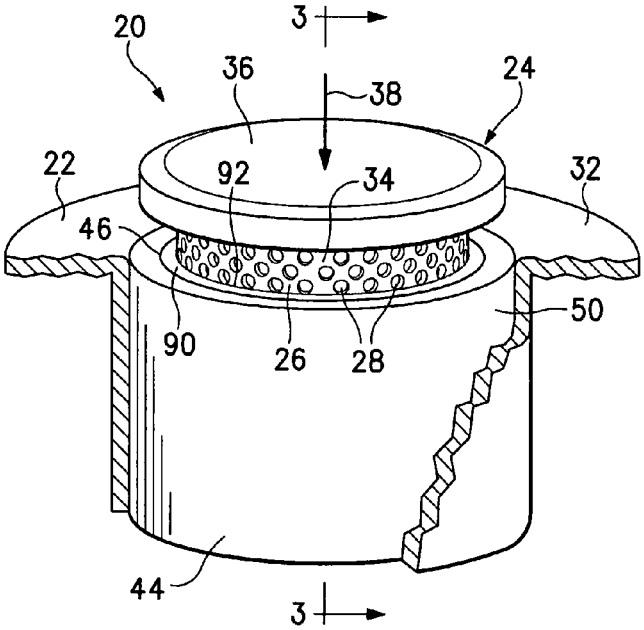
FIG. 1 is a perspective view of a drain-protective device having a size reduction assembly including perforated material and a cap, according to one aspect of the present invention.

Referring first to FIGS. 1-5, a manually operable drain mounted device 20 shown assembled in FIG. 1 may be installed in an upwardly open drain strainer or like receptacle 22, as in the strainer portion of a sink, bathtub, or shower drain, for disposal of solid materials commonly encountered in a household or office, other than in a kitchen, such as hair, thread, fingernails, soapy residues, and so forth.

Referring to FIG. 1 the device 20 is in a ready condition, before operation, fitted in a typical drain strainer 22. A movable size reduction assembly 24 includes a cylindrical perforated tube 26 defining perforations 28, shown as circular holes, but which could also have other shapes. The size, spacing, and number of perforations 28 can be varied to obtain desired flow rates and to target certain materials entrained in a flow of liquid to be drained. A bottom portion 30 of the centrally positioned perforated tube 26 extends within and below the top 32 of the drain strainer 22, while a perforated upper portion 34 extends upward above the drain strainer bowl to receive the liquid to be drained. Hairs and long fibrous materials carried in a flow of liquid tend to extend circumferentially around the upper portion 34 as they are strained from the liquid. A cap 26 covers and is fastened to an upper end of the centrally positioned perforated tube 26 so that the user of the device 20 has a comfortable surface on which he or she may push downward to operate the device 20. Typically, downward pressure exerted easily by the user's foot or hand upon the cap 36 is, sufficient. The cap 36 may have a smooth top surface for comfort of the user during actuation of the device. As a user pushes on the cap 36, the size reduction assembly 24 moves vertically downward, as indicated by the arrow 38, and a rotational component of motion can be imparted by rotating the user's foot or hand somewhat to rotate the cap 36 as it moves down.

Located inside the perforated tube 26 is a spring 40 used to return the perforated tube and the cap to their original positions after being depressed. While a central coil spring 40 is ideal, it should be recognized that alternatives such as leaf springs and other arrangements are acceptable. The spring 40 may be supported directly by the cross-member supports 42 found in the bottom of the strainer portion 22 of the typical drain receptacle. The spring 40 is compressed between the cap 36 and cross members 42 common in the strainer 22 of a drain, by the movement of the size reduction assembly 24.

The movable size reduction assembly of the device may be positioned centrally in a stationary body portion 44 of the device and may be coupled to the spring 40. Alternatively, the spring 40 can also be mounted within the space enclosed by the stationary body 44 of the device, which, in turn, distributes the forces involved to the structure of the drain. The spring 40 or other suitably elastic material may be sheathed in a protected area of the device to prevent fouling from hair.

Figure 2:
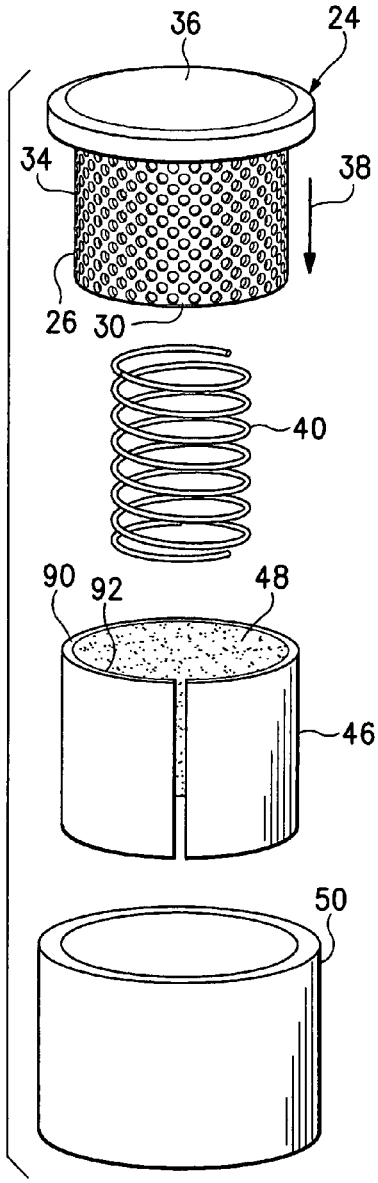
FIG. 2 is an exploded perspective view of the device shown in FIG. 1.
Figure 3:
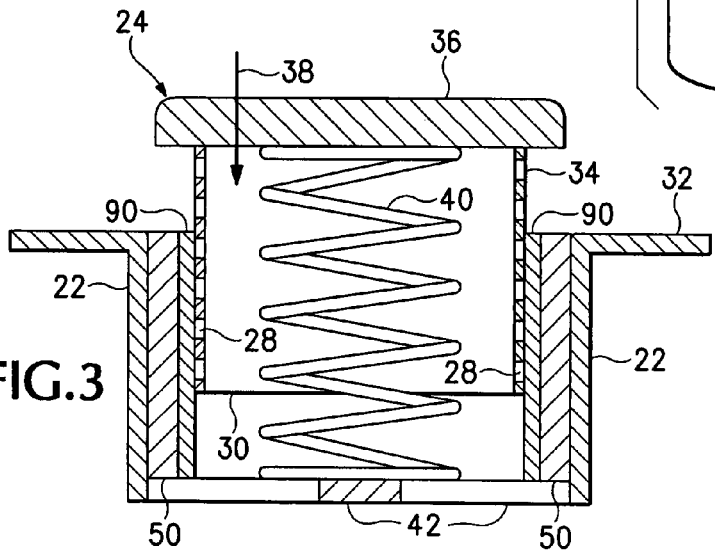
FIG. 3 is a sectional view taken along line 3-3 of FIG. 1.

As shown in FIG. 2, the stationary body 44 includes an inner sleeve 46, which has an abrasive inner surface 48. The sleeve 46 is held in within the strainer 22 of the drain, apposed to the exterior of the perforated tube 24. The abrasive surface 48 may, for example, include particles of a durable abrasive, such as boron carbide, aluminum oxide, or aluminum silicate, held in a suitable matrix adhered to a sheet metal backing. The abrasive material can be held against the surface of the movable perforated tube 26 using any one of various structures. One option is the use of an outermost sleeve 50 of suitably elastic material, e.g. neoprene rubber, squeezing the abrasive surface 48 against the movable perforated tube 26.

Maintenance of close apposition between the two parts is desired, as the abrasive surface 48 may wear away the perforated tube 26, allowing hair to slip between it and the abrasive surface 48 if this apposition is not at least partially maintained.

A sleeve 46, including the abrasive coated surface 48, may also serve to protect the inside surfaces of pre-existing drain strainer 22. With such a protective sleeve, the householder need not worry about damaging existing plumbing by use of the drain-mounted device 20 disclosed herein.

Alternatives to coating the inside surface of the sleeve 46 with an abrasive include coating the perforated material 26 of the movable size reduction assembly 24 with an abrasive layer 48, and coating both surfaces. One should recognize that regardless of which surface is coated, the hair and other material trapped between the two surfaces is ground into smaller pieces by the abrasive coating (or coatings) as the size reduction assembly is moved downward. The smaller pieces can then be carried through the perforations by the flow of liquid being drained, to flow within the perforated tube and on down through the associated drain conduit without being caught and clogging the drain conduit.

The radially outermost portions of the device 20 may be secured within a typical drain assembly in various ways, or the outer sleeve may be manufactured as an integral part of the drain receptacle such as a strainer 22. For example, the sleeve 46 having the abrasive surface 48 may be tightly fitted within an outer sleeve using an interference or press fit, glue, or other fastening means, and the outer sleeve may be similarly fitted within the drain assembly. Securing the stationary body portion 44 holds the drain-protective assembly 20 in place, while the waste material acted on by the abrasive surface 48 is comminuted into smaller pieces less likely to accumulate and clog distal portions of the typical drain conduit. Surfaces and parts prone to wear during normal use of the device, such as perforated tube 26, abrasive material 48, and outer sleeve 50, may be replaceable.

The device described thus provides for straining of solid material from liquid flowing into a drain, and for subsequent comminution of the strained material between the movable size reduction assembly and the apposed surface of an outer sleeve. The spring 40 returns the movable size reduction assembly 24 to its original upper position with respect to the stationary body 44, and thus readies the device 20 for subsequent downward strokes to subdivide pieces of hair and other solid waste. The device 20 is then cleaned by the liquid being drained, flushing comminuted waste material down through the interior of the perforated tube 26 after it has been rendered less likely to clog distal parts of the drain conduit. The comminution of hair and other pieces of waste materials by an abrasive material in some embodiments of the device disclosed herein gives advantages over devices focused primarily on straining of material from the liquid stream. While the use of an abrasive surface reduces the importance of holding hair in a certain orientation in order to be comminuted, the usual orientation resulting from the flow of liquid into perforations is generally circumferential with respect to the movable size reduction assembly 24 and thus generally perpendicular to the direction of relative movement. As a result an abrasive can grip, tear, or cut a long fiber or hair efficiently into several shorter pieces.

Thus, cleaning a drain receptacle equipped with the manually operable device 20 requires no effort beyond the simple actuation described above.

Figure 4:
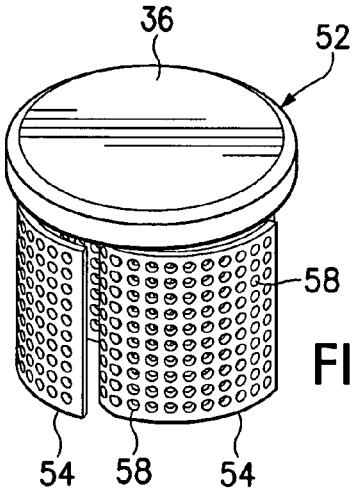
FIG. 4 is a perspective view from above and to a side of a size reduction assembly structure including an alternative perforated cap, according to one embodiment of the device disclosed herein.
Figure 5:
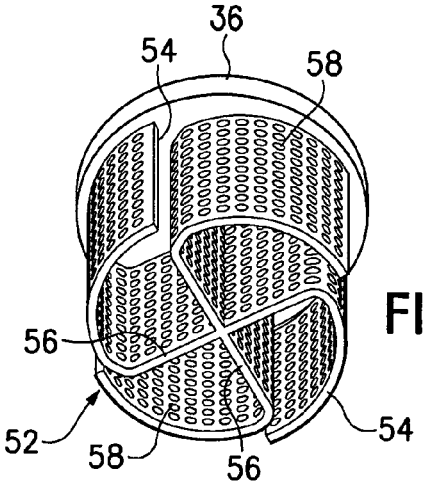
FIG. 5 is a perspective view of the assembly shown in FIG. 4, taken from an opposite viewpoint.

FIGS. 4 and 5 show an alternative movable size reduction assembly 52 for use in the device, in which an alternative arrangement of perforated material is attached to a cap 36. Several closely adjacent sections 54, in the form of generally cylindrical sectors of the perforated sheet material (in this case four sections) are supported by respective radially extending portions 56 so that the sector sections 54 jointly form a generally cylindrical tubular shape. The perforated sheet material of the sections 54 is elastically biased outward and is shaped to allow each of the perforated sections 54 to conform to and appose itself against the surrounding abrasive surface 48 when the size reduction assembly 52 is in place within a surrounding sleeve 46. The perforated material may be sheet metal to achieve an optimum combination of durability and elasticity, and perforations 58 may be arranged in perpendicular columns and rows. This construction eliminates the need for a rubber or other elastic outer sleeve to hold a part including an abrasive surface against the perforated material.

Figure 6:
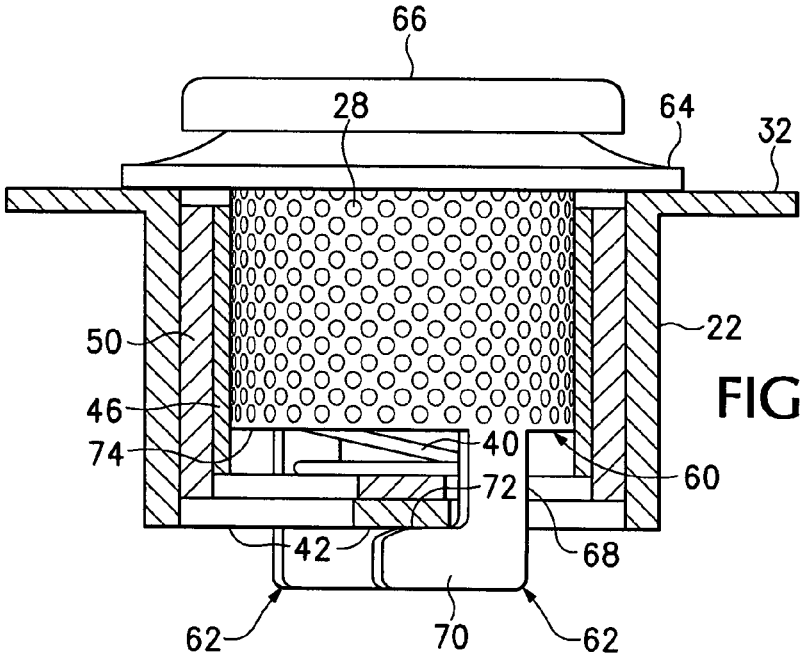
FIG. 6 is a sectional view of an alternative drain-protective device including a seal and a bayonet latching feature.

An alternative embodiment of the manually operable device, shown in FIG. 6, includes a perforated a size reduction assembly 60 having a bayonet-type catch 62. The bayonet mounting catch 62 may be included in a manually operated drain protective device 20 so that the user can choose to plug the drain and keep water in the basin or tub. A radially-extending sealing member 64 of a resilient flexible material such as rubber is located beneath a cap 66. The bayonet mounting catch 62 may include a downwardly depending member 68 and an arm 70 extending generally horizontally. A top surface 72 of the arm 70 may be sloped to oppose the force of the spring 40 and draw and keep the size reduction assembly 60 down and thus bring the sealing member 64 into contact against the top 32 of the flange of a drain strainer 22, sealing the drain and preventing water from escaping the basin or tub. A bayonet mounting catch 62 can be included as an integral part of a perforated tube 74, which may otherwise be similar to the tube 26. This bayonet mount can be engaged with one of the cross members 42 common to the strainer member 22 of a drain.

Figure 7:
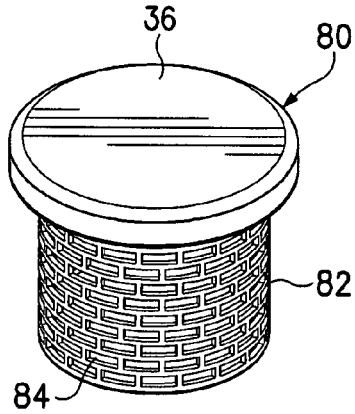
FIG. 7 is a view similar to FIG. 4, showing an assembly having a different perforated material structure.

FIG. 7 shows a movable size reduction assembly 80 including a tubular structure 82 of a different perforated material that includes rectangular cutouts or slots 84 instead of circular holes 28 as shown in FIGS. 1-6. Other perforation patterns may also be used, but particular perforation patterns may offer improved performance depending upon the configuration of the apposed sleeve. For example, diagonally arranged circular perforations 28 may be preferred for a perforated tube 26 when assembled with an abrasive surface 48 as in FIG. 2.

As another alternative, instead of including the sleeve 46 having an abrasive surface 48 apposed to the perforated tubular structure, a manually operable drain protective device 20 as shown in FIGS. 1-6 may include a sleeve 46 having an upper face 90 defining a shearing edge 92. The shearing edge 92 abuts the perforated material such as that of perforated tubes 26, 74, or 82, or the sectors 54. The radial clearance between the shearing edge 92 and the surface of the perforated tube 26, etc., may be made fairly small, as in the range of 0.0005 to 0.002 inch, to effectively trap and shear small diameter fibers such as hairs when the perforated tube is moved downward. The sleeve 46 defining such a shearing edge 92 could be made of corrosion resistant metal, though it need not be limited to such a material. The sleeve 46 may also serve as a protective sleeve inside a typical pre-existing drain strainer. As described above, a compressing outer sleeve 50 of an elastic material of an appropriate diameter to fit over the sleeve 46 may be used to squeeze the sleeve 46, and its edge 92, toward the perforated tube 26 to eliminate excessive clearance. However, simply maintaining tight engineering and manufacturing tolerances may eliminate the need for such a sleeve 50.

Orientation of hair is preferably perpendicular to cooperating shearing edges. The perforations 28 and 58 of the perforated material are circular in shape as shown in FIGS. 1-6. Initially, hair would be carried in the flow of liquid toward the exterior of the perforated material and trapped against the perforated material, oriented parallel with the surface of the perforated material. However, parts of the hair will bend and extend into the perforations 28 as the size reduction assembly is moved downward, placing parts of the hair perpendicular to the surfaces defining shearing edges.

In the perforated tube 82, shown in FIG. 7, the perforations 84 are rectangular and may be inclined slightly from the horizontal so as to allow parts of hairs to better arrange themselves perpendicular to the shearing edges defined by the perforations 84, and to introduce an improved "scissor effect" as the perforated tube 82 moves along the shearing edge 92 in a version of the device similar to the ones shown in FIGS. 1-6.

Figure 8:
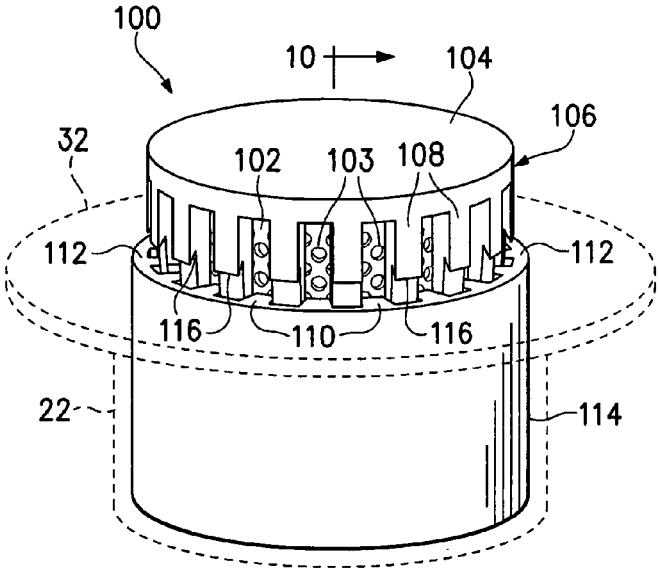
FIG. 8 is a perspective view of a drain-protective assembly having perforated material and a cap including straining fingers, according to another alternative embodiment of the device disclosed herein.
Figure 9:
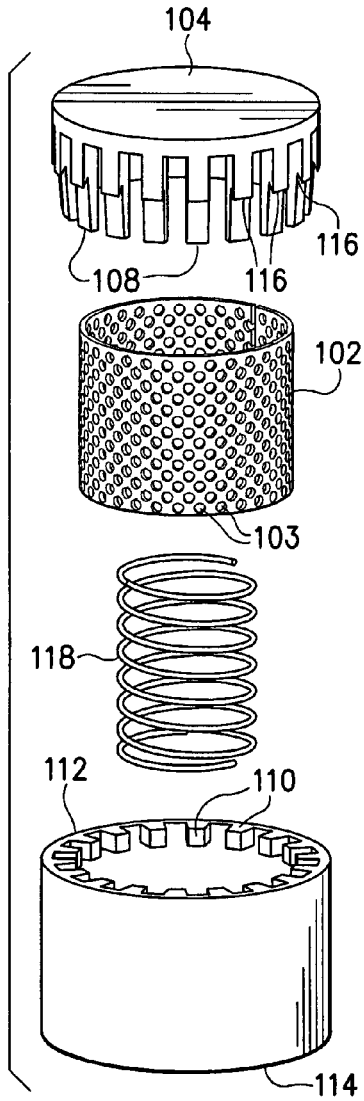
FIG. 9 is an exploded perspective view of the device shown in FIG. 8.
Figure 10:
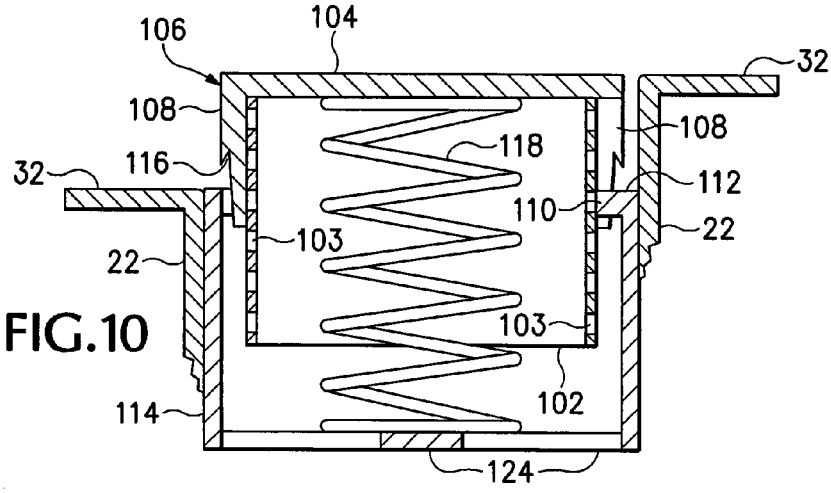
FIG. 10 is a sectional view, taken along the line 10-10 in FIG. 8.

Referring to FIGS. 8, 9, and 10, a manually operable drain protective device 100 is shown in FIG. 8 in a normal liquid-receiving condition, sitting in a strainer member 22 (shown in broken line) of a typical drain assembly. The strainer member 22 includes a radial flange whose upper surface 32, when the strainer is installed in a typical sink, tub, or shower, sits substantially flush with the interior surfaces of the drain area of the sink, tub, or shower, and is connected to the lower inlet bowl or receptacle portion of the drain assembly, leading downward into the drain conduit leading away from the sink, tub, or shower. The bottom portion of a centrally positioned perforated tube 102 is below the height of the flange of the drain receptacle. The tube 102 has perforations shown as round holes 103, but slots such as the slots 84 shown in FIG. 7 could be provided instead. There is a cap 104 attached to the upper end of the centrally positioned perforated tube 102 so that the user has a comfortable surface that he or she may push on when moving the size reduction assembly 106, which includes the cap 104 and the perforated tube 102. With perforations 103 between the screening fingers 108 above the level of the sink or tub bottom surface, solid material caught by the device at the tub or sink level will not impede flow of liquid into the perforations above that level.

The cap 104 includes an array about its periphery of screening fingers 108, vertically oriented members resembling bars or fingers, extending downward close to or in contact against the outside of the perforated tube 102, and between which the portion of the perforated tube 102 extending upward above the level of the flange is visible. The vertically oriented screening fingers 108 serve to strain pieces of solid material from a flow of liquid. Given their straining function, the vertical screening fingers 108 extending downward from the top surface of the cap 104 may obviate the need for the perforated tube 102 if improved flow of liquid into the drain mounted device 100 is desired. The screening fingers 108 extend into respective passageways defined between cooperatively mating radially inwardly directed teeth 110 spaced apart along an upper rim or shoulder 112 of the surrounding stationary body 114. There may be a close sliding fit between each finger 108 and the adjacent surfaces of the inwardly directed teeth 110, so that hair and other material trapped between the fingers 108 and the teeth 110 is sheared or ripped as the movable size reduction assembly 106 is pushed downward and the fingers slide past the teeth. The space between the surfaces is optimized to tolerances that sufficiently trap, rip, and cut small diameter materials such as hairs while avoiding simply pushing the materials into the plumbing without having been appropriately comminuted. The cutting, ripping, and screening fingers 108 and teeth 110 may desirably be made of corrosion resistant metal, though they need not be limited to such a material and they may be coated with an abrasive to help grasp materials.

Pieces of the cut or ripped material after passing between the fingers 108 and the teeth 110 are smaller in size, small enough to flush into the fluid stream and downward past the drain protective device 100 and other plumbing obstacles. At least some of the fingers 108 may define downwardly open notches 116 on their outer faces, to engage and carry pieces of waste material, particularly hairs and other fibers, to pull the pieces between the teeth 110 and thereby rip, tear, or cut them into smaller pieces.

Beneath the cap 104, inside the perforated tube 102, is a spring 118 used to return the movable size reduction assembly 106 to its original position. As the user pushes downward on the cap 104, the size reduction assembly 106 of the device moves vertically downward within the stationary body 104, guided by the relationship between the fingers 108 and the teeth 110, which are shown in a simple straight configuration, although they could be shaped to impart a helical component to movement of the size reduction assembly 106.

In one embodiment of the device 100, the fingers 108 may be located below the top face 32 of the flange of the drain strainer 22, as shown at the right side in FIG. 10. The fingers 108 move closely along and between the teeth 110 located along the top rim 112 of the stationary body 114 to provide a cutting function, but the cutting or ripping action occurs below the height of the top surface 32 of the flange for improved safety. With the perforated or slotted material 102 sitting within the drain strainer member 22, the head pressure of water above that level will improve drainage rates. In either location of the fingers 108, the perforated or slotted material 102 serves to separate pieces of solid waste material from a liquid flow and to orient the captured material (such as hair) advantageously for subsequent cutting or ripping. As will be appreciated, the number and shape of the perforations or slots 103 may be varied and may depend upon the materials used in manufacture, the desired flow rates, and acceptable manufacturing costs. Solid material such as hair may fall into the gap 120 between the inner surface of the strainer portion 22 of the drain and the cutting or ripping and screening fingers 108, and the gap 120 may be of an appropriate size to optimize the cutting or ripping function of the drain mounted device. That is, the radial thickness 122 of the stationary body 114 may be varied so as to increase or decrease the effective width of the gap 120.

The spring 118 operates to return the movable size reduction assembly 106 to its original position after compression. The spring 118 may be compressed between the cap 104 and cross members (not pictured) common to typical drain assemblies, or it may be held by horizontal support members 124 included in the bottom of the stationary body 114 to provide a supporting seat for the spring 118. The outermost portions of the stationary body 114 may be secured to a typical drain assembly strainer 22 in any of several ways, (for example, pressure fitting, screw threads), or may be manufactured as an integral part of strainer member of the drain receptacle. Although cross members (not shown) that may be included in the typical drain assembly provide a bottom structure that can support the drain-protective device 100 when the device is actuated, the stationary body 114 may be secured to the inner surfaces of the drain strainer 22 to hold the drain-protective device 100 in place while the size reduction assembly 106 moves vertically during operation of the device.

Given that hair is a primary cause of clogging, the drain protective device shown in FIGS. 8-10 has been designed to cut and rip hair. Typically, hair will align itself perpendicular to the vertical motion of the movable size reduction assembly. As the screening fingers 108 move past the teeth 110 on the rim 112 they have a tendency to roll, twist, and tangle hair into a complex strand. This strand is easily torn as the fingers 108 and teeth 110 move past each other, stretching the tangled strand to the point that the individual hairs break. A tangled strand of hair may thus be cut or torn into small parts roughly equal in length to the distance between adjacent fingers 108. As this woven or tangled strand may sometimes pull apart instead of simply breaking as the fingers 108 move past the teeth 110, the fingers 108 may be designed to hold the strand so as to carry it between the teeth 110. For example, outer surfaces of the fingers 108 may be roughened. Such roughened fingers 108 would tend to hold hairs in a fixed position, for subsequent ripping as the fingers 108 move past the teeth 110. The cutting and ripping function of the fingers 108 may also be optimized by varying their shape, sharpening their edges, or coating them with abrasives.

In a manually operable drain protective device 123 shown in FIGS. 11, 12, 13, and 14, pieces of solid waste, including hair, are strained from a flow of liquid in a strainer cup 130 with a perforated bottom. The drain device 128 may be manufactured to fit snugly into a common drain receptacle such as the strainer member 22 of a typical drain assembly. Blades 132 and 134 including cutting or ripping surfaces cut, tear, or rip larger pieces into smaller pieces as a size reduction assembly 136 moves up and down.

Figure 11:
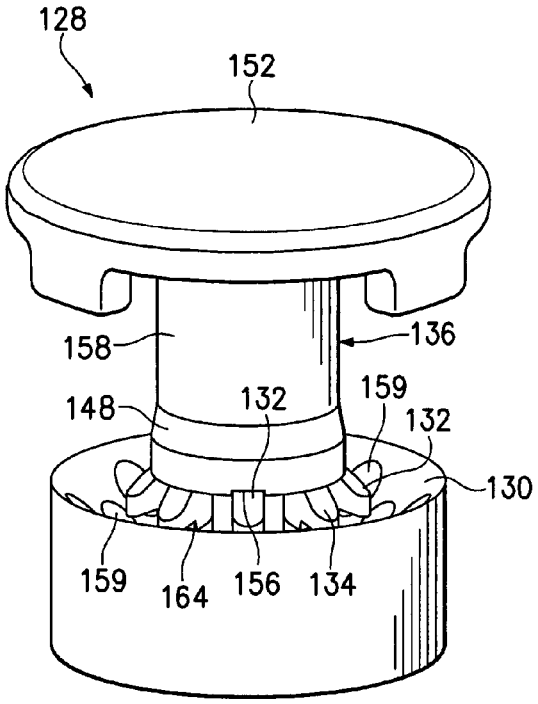
FIG. 11 is a perspective view of a drain mountable assembly which is yet another alternative embodiment of the drain-mounted device disclosed herein.
Figure 12:
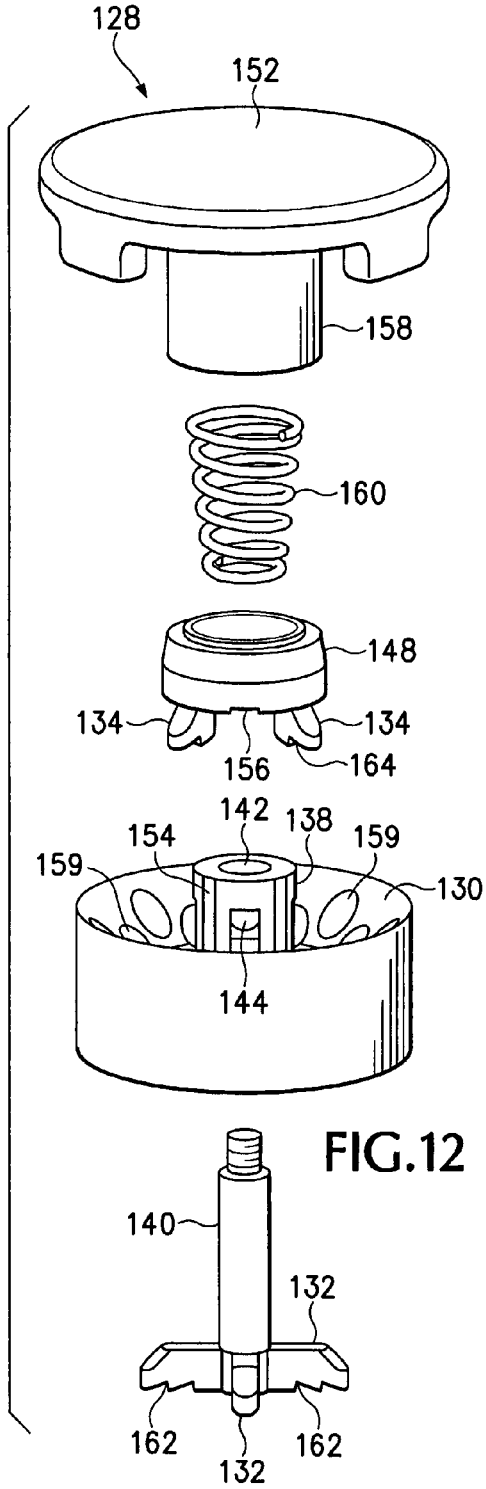
FIG. 12 is an exploded perspective view of the device shown in FIG. 11.

A central tower-like body 138 extends upward from the bottom of the cup 130, as may be seen best in FIG. 12. A shaft 140 carries one or more radially extending cutting or ripping blades 132 on its lower end, four such blades being included in the device 128 as shown herein. The shaft 140 extends up through a central passageway 142 in the tower-like body, which defines radial slots 144 communicating with the central passageway and located to allow the blades 132 to slide up into the cup 132 to the position shown in FIGS. 11 and 14. The bottom of the strainer cup 130 also defines slots 145 into which the cutting or ripping blades 132 can move as the size reduction assembly 136 is moved downward from the position shown in FIGS. 11 and 13. For example, the slots 145 may be about 0.2 inch wide and may have a radial length 147 of about 0.325 inch to 0.65 inch. The slots 144 and 145 that allow the cutting or ripping blades 132 to pass downwardly through the strainer cup 130 may comprise an X-shaped slot, closely corresponding to the shapes of the cutting or ripping blades 132. The slots 145 may also define edges 146 against which hair trapped by the moving blades may be ripped or sheared.

The upper cutting or ripping blades 134 extend from a carrier body 148 and are aligned with additional slots 150 in the cup bottom, which may also have sharp edges, and into which the cutting or ripping blades 134 can move to rip or cut pieces of solid waste. The carrier body 148 may be a generally cylindrical sleeve that fits slidably around the tower-like body 138 and can be moved upwardly and downwardly together with a cap 152 attached to the central shaft 140. To keep the blades 134 aligned with the holes in the strainer cup one or more inwardly protruding ribs may be provided inside the carrier body 148 to move in mating grooves 154 extending along the tower-like central body, and notches 156 may be defined in the carrier body 148 to mate with the blades 132. The cap 152 may include a hollow cylindrical connector tube portion 158 extending to the carrier body 148, so that moving the cap downward moves the shaft 140, the blade carrier 148, and the cutting or ripping blades 132 and 134.

The cutting or ripping blades 132 and 134 may correspond closely in size and shape with the respective slots 144 and 150 in the strainer cup 130, and they may have sharp edges to cooperate with the edges 146 in shearing solid waste material. By having several cutting or ripping blades separated by only a small distance from one another the size reduction assembly 136 can press a long strand of hair or other fibrous material into several slots 144 and 150 simultaneously, thereby cutting or shearing the strand into several smaller or shorter pieces each small enough to pass freely through a drain without clogging the drain conduit.

Figure 13:
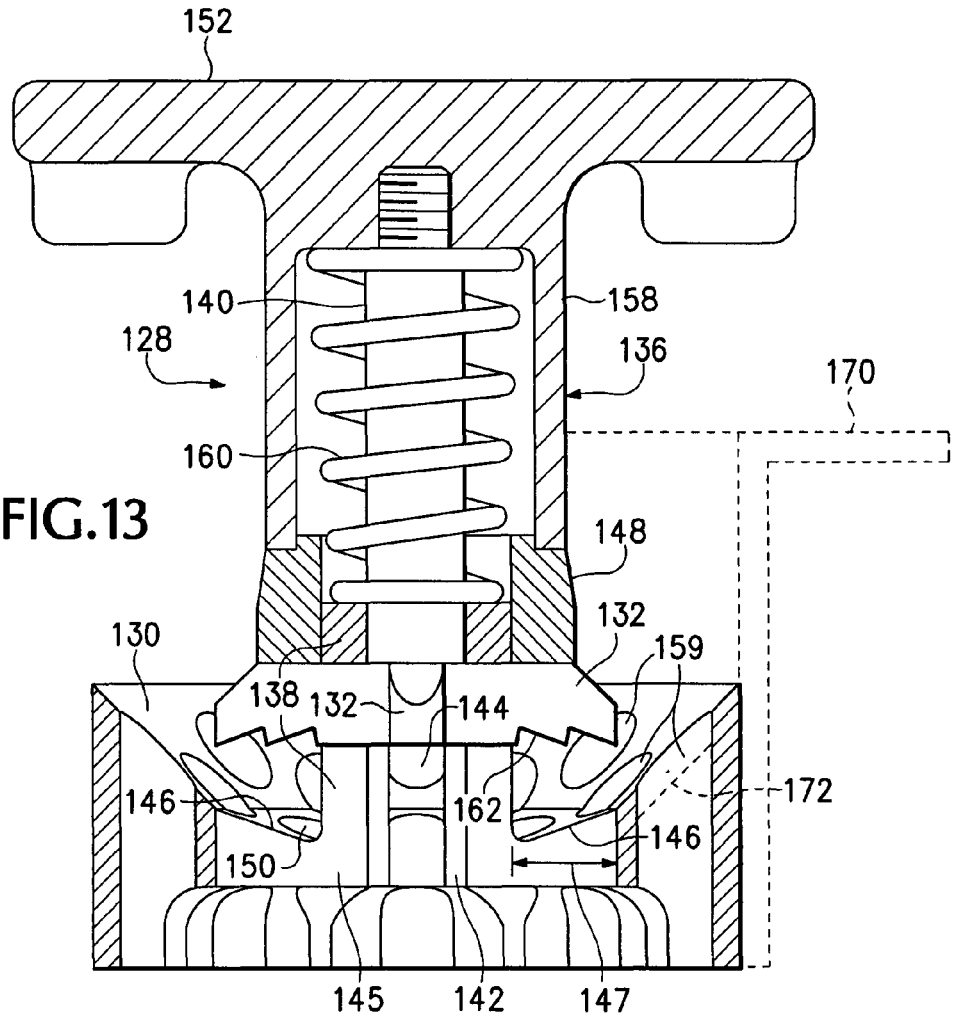
FIG. 13 is a sectional view of the device shown in FIG. 11, taken along line 13-13 in FIG. 11.

The strainer cup 130, as shown in FIG. 13, may be conical or arcuately concave so as to guide material carried in a flow of liquid into the top of the device 128 toward a location under the cutting or ripping blades 132 and 134 and thus to orient hairs and other slender elongate pieces so that they tend to lie circumferentially about the central tower-like body 138. The lower portion or underside of the strainer cup 130 may be concave, as shown in FIG. 13.

Circular or otherwise shaped perforations 159 may be spaced about the strainer cup 130 as shown. The perforations 159 of the strainer cups 130 are, preferably, optimally sized to balance efflux of liquid from the cup 130 with the function of trapping solid material.

A suitable spring, such as a coil spring 160, sits on the top surface of the tower-like body 138 inside the strainer cup 130. The shaft 140 extends up through the center of the spring 160 and is attached, as by mating threads, to the bottom of the cap 152. The spring 160 returns the cutting or ripping blades 132 and 134 to their original or upper position after the size reduction assembly 136 has been moved down.

When the cap 152 is pressed downward, the cutting or ripping blades 132 and 134 move down through the corresponding slots 144 and 150 within the strainer cup 130. Material trapped in the strainer cup 130 is macerated to a size that allows the material to eventually be flushed down the drain. The downwardly extending cylindrical center portion 158 of the cap 152 fully encloses the spring 160, protecting the spring 160 from becoming fouled with hair or other solid waste material that flows into the strainer cup 130 of the drain.

Figure 14:
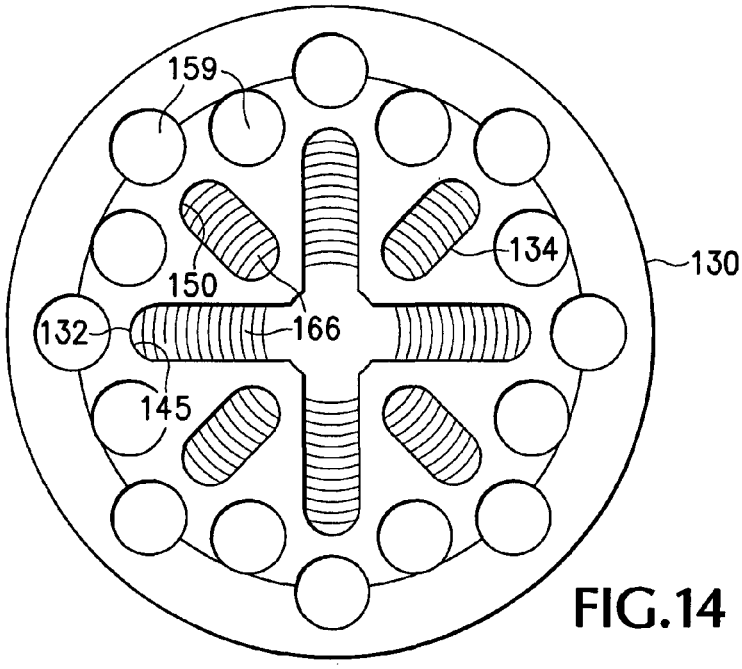
FIG. 14 is a bottom plan view of the device shown in FIG. 11.

The cutting or ripping surfaces of the blades 132 and 134 may be optimized to grasp hair or other material by roughening, sharpening, or coating them with abrasives, by forming waste-holding grooves, such as notches 162 and 164 shown in FIG. 12, or by forming narrow shallow hair-holding grooves 166 as shown in FIG. 14. The bottom surfaces of the cutting or ripping blades 132 and 134 or the inner surface of the strainer cup 130, both of which provide for cutting or ripping trapped material with downward movement of the size reduction assembly 136, may be thus optimized.

Alternatively, the strainer cup 130 may be formed integrally with a flanged drain receptacle, or strainer 170, as shown in the right side of FIG. 13, that can be installed in place of a conventional strainer member 22 in the bottom of a sink, etc., as opposed to being a "drop-in" device such as the device shown in FIG. 11. The flanged strainer portion of the drain receptacle may comprise a concave or cup-shaped bottom member 172 having a substantially constant material thickness, as contrasted with the concave bottom of the cup 130.

Yet a further alternative drain protective device 180, shown in FIGS. 15, 16, 17, and 18, may be manufactured in a size appropriate to fit snugly within a strainer portion 182 of a conventional drain for a tub, shower, or sink, in which the strainer portion 182 includes a horizontal bottom support cross member 184 defining a threaded hole 186 centered within the strainer bottom. The device 180 includes a perforated bottom strainer and cutting plate 188 which is stationary and may be supported a small distance above the horizontal bottom cross members 184 of the strainer 182, as shown best in the section view in FIG. 18. A movable size reduction assembly 190 includes vertically extending members hereinafter referred to as fingers 192, arranged to move downwardly into respective ones of a set of corresponding holes 194 extending downward through the bottom plate 188 to cut or tear solids in a flow of liquid into pieces small enough to be flushed down through a drain system safely. The upper edges of the holes 194 may be sharp.

A central support shaft 196 may be attached to the bottom cross member 184 of the drain strainer 182, and in most cases will be able to be threaded solidly into a mating relationship with the threaded hole 186. The bottom strainer and cutting plate 188 defines a central opening 198 to receive the shaft 196, and a spring cover 200, in primarily the form of an upstanding wall mounted on a horizontal octagonal base, is located in a fixed position atop the bottom plate 188, as by a pair of pins 202 located in opposite ones of a set of four through-bores 204 defined in the bottom plate. The other two through-bores 204 in the bottom plate 188 are aligned with respective holes 205 that extend through the base portion of the spring cover 200, to allow for drainage from within the spring cover.

A central body 206 has a generally cylindrical shape, and the vertically oriented fingers 192 extend parallel with one another and are spaced apart from each other about the cylindrical central body 206. Each of the fingers 192 has a lower end portion 208 that extends downward independently and that may have a rough or abrasive-coated surface or may define a shallow groove 210 aligned generally tangential to the circumference of the central body 206. The lower end portion 208 of each finger is aligned with one of the correspondingly shaped holes 194 defined by the bottom plate 188, and may have sharp edges to cooperate with sharp edges of the related hole 194. Additional through-holes 195 extend through the bottom strainer and cutting plate 188 as passageways for liquid to drain through the drain-protective device 180.

The central body 206 is hollow and has an open bottom end that fits around the spring cover 200. An inner side of each finger 192 may be aligned with a respective flat side of the spring cover. The central body 206 is movable reciprocatingly upward and downward, between an upper position, in which the lower end portions 208 of the fingers 192 are located a small distance above the bottom plate 188, and a lower position, in which all of the lower end portions extend downward into respective ones of the correspondingly shaped holes 194 in the bottom plate 188.

Figure 16:
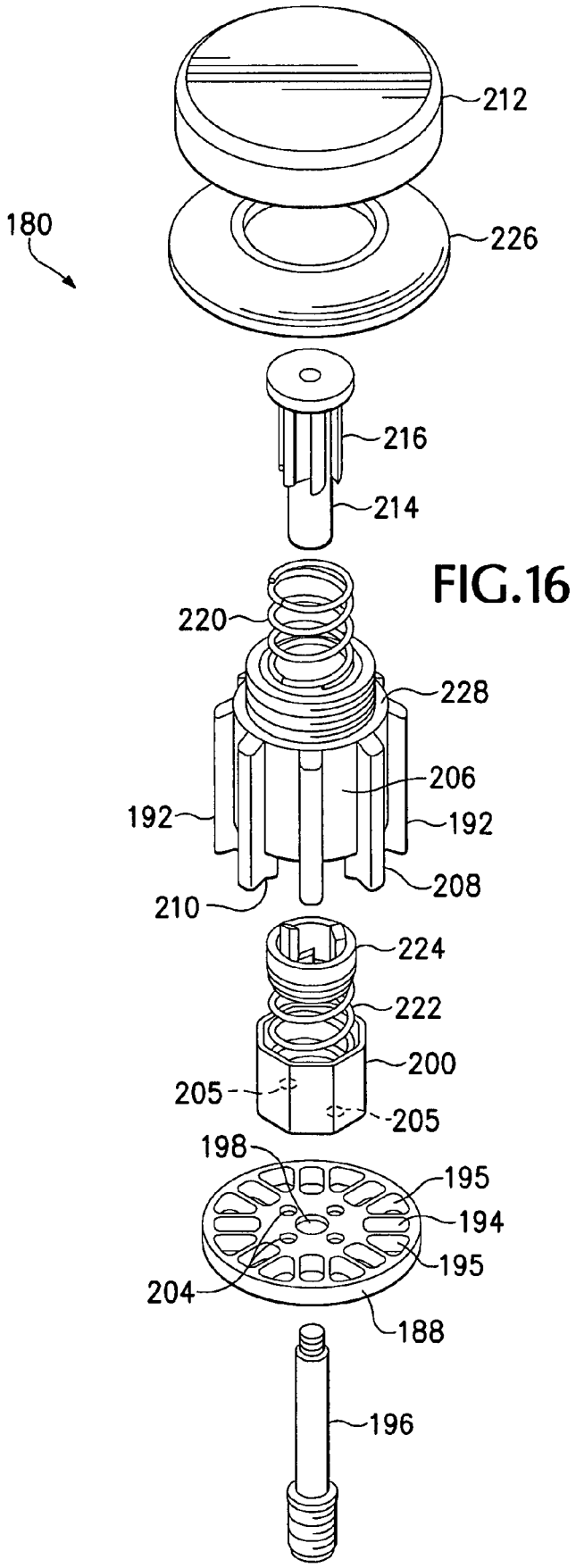
FIG. 16 is a exploded perspective view of the device shown in FIG. 15, at a reduced scale.
Figure 18:
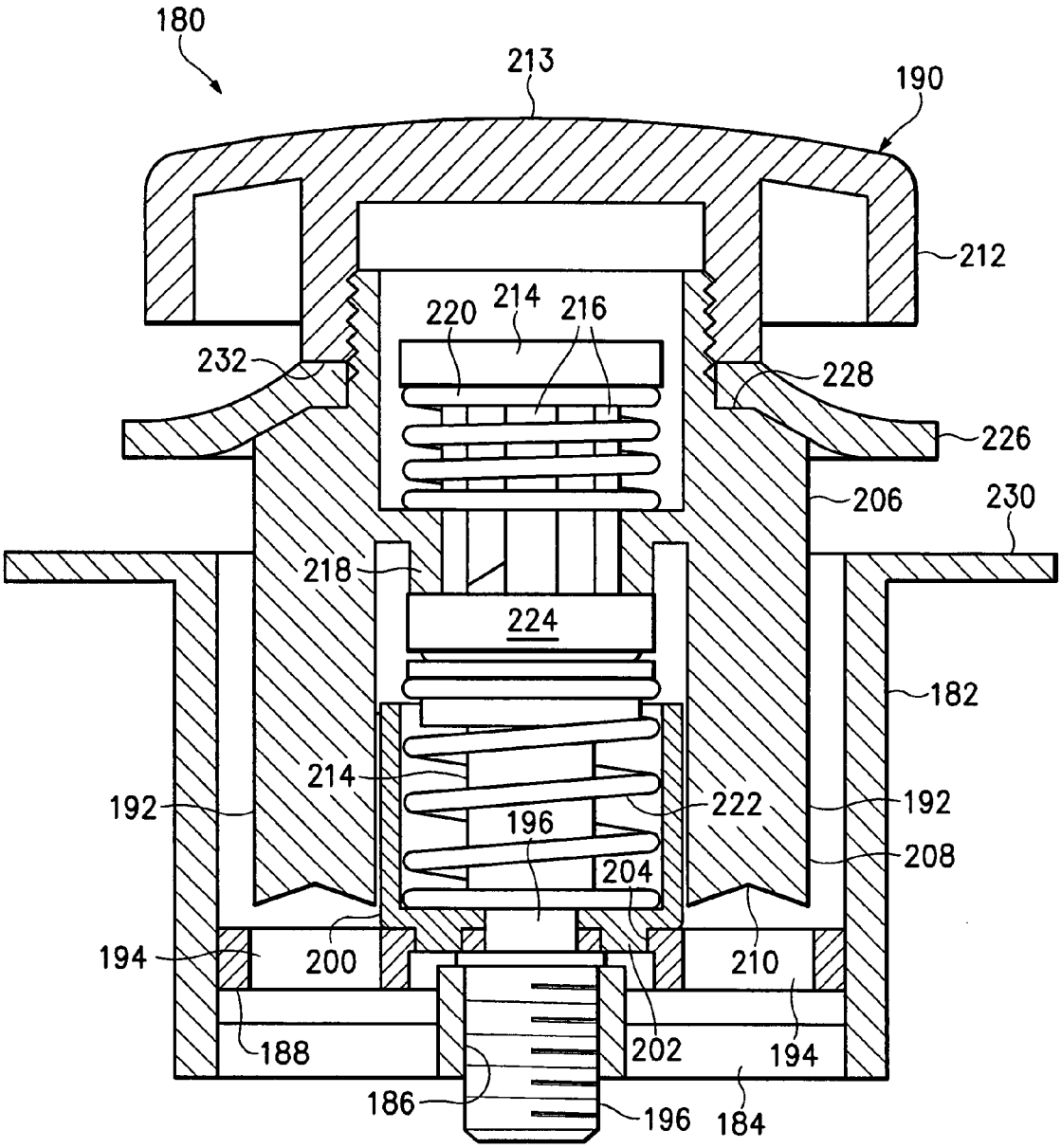
FIG. 18 is a sectional view of the device shown in FIG. 15, taken along line 18-18 and showing a strainer portion of a drain in which the device is installed.

A stepping mechanism is enclosed within the spring cover 200 and the movable central body 206 and allows the size reduction assembly 190 to be moved downward and latched into its lower position by pressing downward on a cap 212 connected to the top of the central body 206. The cap 212 has a comfortable upper surface 213 that can comfortably be pressed by a hand or foot. The size reduction assembly 190 may then be released and raised to the upper position by a succeeding downward movement of the cap 212 and the attached central body 206. In one such stepping mechanism, as shown in FIGS. 16 and 18, a hollow shaft 214 portion of the stepping mechanism is mounted fixedly on the upper end of the central support shaft 196. Vertical ribs or flutes 216 on the outside of the hollow shaft 214 form a part of the stepping mechanism. Grooves defined between the flutes 216 receive inwardly projecting bodies 218 located within the upper end of the central body 206, so that the hollow shaft 214 guides and aligns the upper end of the central body 206 with the central shaft 196 as the size reduction assembly 190 moves reciprocatingly upward and downward with respect to the bottom plate 188 and the central shaft 196. An upper spring 220 and a lower spring 222 and a rotating stepping ratchet body 224 arranged in a well-known manner sequentially hold the central body 206 in its upper position and its lower position when it is repeatedly moved fully downward by depressing the cap 212.

Figure 15:
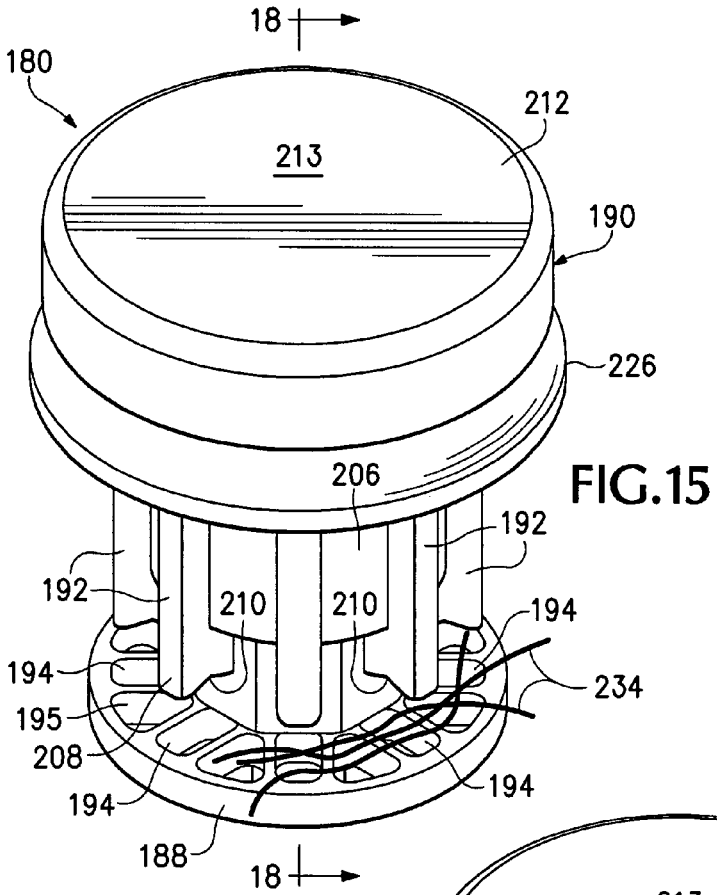
FIG. 15 is a perspective view of a manually operable device for use in a drain which is another embodiment of the device disclosed herein.
Figure 17:
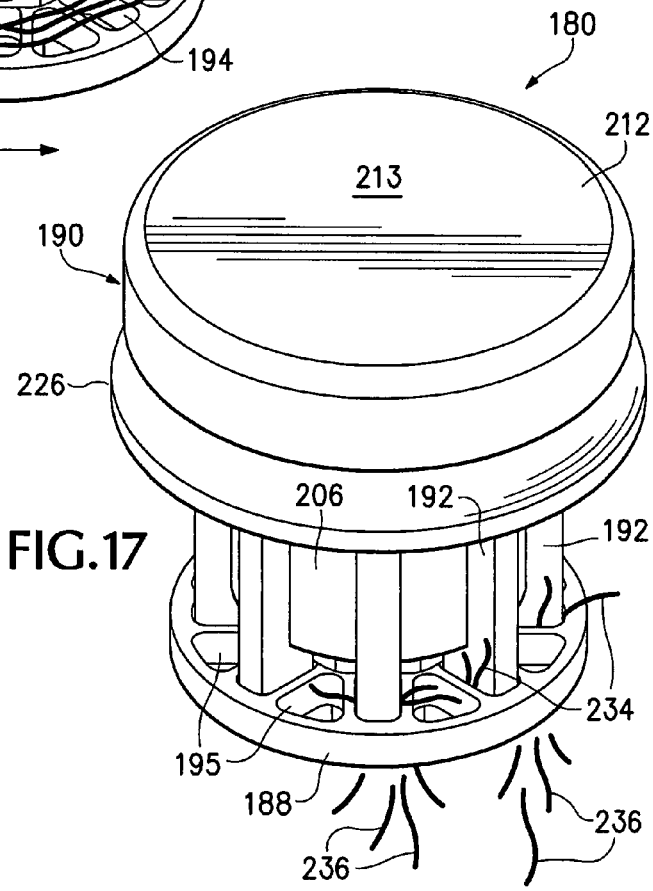
FIG. 17 is a perspective view of the device shown in FIG. 15 with a movable size reduction assembly thereof moved to a lower position.

When the rotating stepping ratchet body 224 is in a lower position the upper spring 220 urges the central body 206 toward the lower position, and a seal member shown as a radially extending frustoconical resiliently flexible seal member 226 that fits around an upper shoulder 228 of the central body 206, is also lowered and urged toward the lower position. The seal member 226 then presses against the radially extending flange 230 of the strainer or receptacle portion 182 of the drain, preventing liquid from flowing into the device. When the central body 206 is in its upper position as shown in FIGS. 15 and 18 the seal member 226 is spaced upwardly apart from the flange 230, and liquid to be drained from the tub or sink, etc., in which the device 180 is installed is free to enter the strainer 182 beneath the sealing member.

The cap 212 is held securely atop the central body 206 as by mating threads, and includes a lower rim 232 seated against a central hub of the sealing member 226, so that to enter the drain liquid must pass through the device 180, by flowing beneath the sealing member 226, and then around the outside of the cylindrical portion of the central body 206, between the fingers 192, carrying any entrained waste solid pieces, including hair. Because the fingers 194 are straight and vertical, waste material can be carried unhampered to the bottom plate 188 in a flow of liquid.

As a flow of liquid containing solid pieces of waste material proceeds downward within the strainer shell 182, or stationary body, of the device 180, pieces of solid waste come to rest atop the bottom strainer and cutting plate 188, and at least partially beneath the lower ends 208 of the fingers 192, so that when the central body 206 is moved downward by pressure on the cap 212 the shallow grooves 210 in the lower ends 208 of the fingers 192 grasp and force pieces of solid material through the corresponding holes 194, tearing or shearing relatively large pieces of waste material into reduced sized pieces which are small enough to pass freely through a drain conduit beneath the strainer 182 with greatly reduced likelihood of accumulating so as to clog the associated drain conduit at a distant downstream location.

Even fibrous materials such as hair or pieces of grass will be divided into smaller pieces which are less likely to be able to accumulate within a drain conduit to a troublesome extent. As longer fibrous pieces such as long hairs 234 are carried into the space surrounding the central body 206 those fibers are carried down along the fingers 192 by the flow of water, which aligns such long pieces 234 naturally around the octagonal spring cover 200 as shown in FIG. 15, and the notches 210 in the bottom ends of the fingers 192 help to grasp such fibrous materials and urge spaced-apart portions of strands of entwined such hairs 234 simultaneously through neighboring ones of the corresponding generally rectangular holes 194 through the bottom plate 188, thus either shearing or tearing and ripping the hairs 234 or strands of other fibers into short pieces 236 that, when sufficiently shortened, will drop through the holes 194 in the bottom plate 188 and thereafter be flushed from the device 180 into the flow of liquid into the drain conduit below the device. The lower end of the central support shaft 196 holds the bottom plate 188 spaced a distance above the bottom support members 184 in the drain strainer 182, so that there is a clear path for the flow of liquid passing through the bottom plate 188 to carry such reduced size pieces of waste material.

Pieces of waste material which are not divided sufficiently with a first downward stroke of the size reduction assembly 190 can be further reduced by subsequent downward strokes of the size reduction assembly from its upper position to its lower position in which the lower ends of the fingers 192 pass into the holes 194.

When the cap 212 is depressed far enough to move the central body 206 fully into its lower position the sealing member 226 engages the radially extending flange stopping the flow of liquid into the drain strainer 182, so that the device 180 seals the drain and retains liquid in the sink, shower, or bathtub in which it is installed, until the cap 212 and attached central body 206 are allowed to rise slightly and are thereafter again pushed downward, operating the stepping mechanism centrally located within the drain protective device 180. The central body and the spring cover may fit together slidingly, and, although there is room for entry of water into the space defined within the spring cover, the holes in the bottom of the spring cover allow the water to drain freely, and the space between the central body 206 and the spring cover 202 may be small enough to prevent entry of waste material that would be likely to interfere significantly with operation of the stepping mechanism. While the entire device 180 could be of metal, several parts could, instead, be of a suitable plastics material to reduce costs.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A manually operable device for use in a household drain inlet receptacle for helping to maintain free flow of liquid through a drain conduit connected with the receptacle, comprising:

(a) a stationary main body;

(b) a strainer portion located at least partially within the stationary main body in position to receive a flow of liquid and to catch relatively large pieces of solid waste material and temporarily hold said relatively large pieces;

(c) a manually movable size reduction assembly extending within the stationary main body and reciprocally movable with respect to the stationary main body, between an upper position and a lower position; and (d) a spring urging the movable size reduction assembly toward the upper position thereof; and (e) wherein the manually movable size reduction assembly engages at least some of said relatively large pieces of waste material and acts cooperatively with the stationary main body, to reduce at least some of said engaged pieces of waste material to a smaller size while said movable size reduction assembly is being moved between said upper and lower positions thereof.

2. The device of claim 1 wherein said strainer portion is included in said movable size reduction assembly.

3. The device of claim 2 wherein said stationary main body includes an elastic outer member urging a sleeve including an abrasive surface inwardly toward an exterior surface of said strainer portion.

4. The device of claim 2, wherein said strainer portion includes a perforated tube of sheet material and said movable size reduction assembly includes a cap located adjacent an upper end of said perforated tube and said perforated tube includes an outer surface apposed to a shearing surface of a portion of said stationary main body.

5. The device of claim 1 wherein said stationary main body includes a sleeve and said movable size reduction assembly includes said strainer portion and said strainer portion is apposed to said sleeve and reciprocally movable within said sleeve between said upper position and said lower position.

6. The device of claim 5 wherein said sleeve has an abrasive inner surface and said strainer portion has an outer surface apposed to said abrasive inner surface, whereby waste material can be carried by said strainer into contact against said abrasive surface and said relatively large pieces of waste material can be reduced to smaller size by reciprocating movement of said movable size reduction assembly between said upper and lower positions.

7. The device of claim 5 wherein said strainer portion includes a perforated tube of sheet material and said movable size reduction assembly includes a cap located adjacent an upper end of said perforated tube.

8. The device of claim 7 wherein said perforated tube comprises a plurality of perforated arcuate sectors each biased radially outward toward said abrasive surface by its own elasticity.

9. The device of claim 5 wherein said stationary main body includes an elastic outer member urging said sleeve including said abrasive surface inwardly toward an exterior surface of said strainer.

10. The device of claim 1 wherein said movable size reduction assembly includes a cap and said cap includes an array of vertically oriented parallel screening members disposed in said flow of liquid when said movable size reduction assembly is located in said upper position thereof.

11. The device of claim 1 wherein said movable size reduction assembly includes a cap having an array of vertically oriented fingers extending downward therefrom, and wherein said stationary body member includes a shoulder defining a plurality of passageways aligned to receive respective ones of said fingers as said movable size reduction assembly moves reciprocally from said upper position toward said lower position.

12. The device of claim 11 wherein at least one of said fingers defines a downwardly open notch located on an outer face of said fingers in position to engage one of said relatively large pieces of waste material and carry said waste material downward into a respective one of said passageways.

13. The device of claim 11, said movable size reduction assembly including said strainer portion and said strainer portion comprising a perforated tube attached to said cap and extending downward therefrom, and wherein said vertically oriented fingers extend downward along an outer surface of said perforated tube.

14. The device of claim 1 wherein said strainer portion includes a perforated cup located in said stationary main body and defining a plurality of passageways extending downwardly therethrough, said passageways including a plurality of slots, and wherein said movable size reduction assembly includes an upper m ember, a support member extending downward from said upper member, and a plurality of blades mounted on said support member and aligned with respective ones of said slots in said perforated cup, said blades being located above an upper surface of said perforated cup when said movable size reduction assembly is in said upper position thereof, and said blades being movable into said slots so as to carry waste material and thereby reduce said pieces of waste material to smaller pieces as said movable size reduction assembly is moved downward toward said lower position thereof.

15. The device of claim 14 wherein said stationary main body includes an upwardly extending central tower defining a central passageway and an intersecting lateral slot, one of said blades extending through said lateral slot and said support member extending upward through said central bore.

16. The device of claim 15 further including a collar slidably disposed about said tower and a plurality of blades extending downward from said collar and aligned with one of said plurality of slots defined in said perforated cup.

17. The device of claim 14 wherein said upper member is a cap having a comfortable upper surface.

18. The device of claim 14 wherein said blades and said slots define respective shearing edges aligned with one another to shear said waste material cooperatively.

19. The device of claim 14 wherein one of said blades has a bottom surface defining a waste-holding groove.

20. The device of claim 14 wherein one of said blades has a bottom surface defining a plurality of hair-holding grooves.

21. The device of claim 14 wherein one of said blades has a sharp edge.

22. The device of claim 14 wherein said strainer is formed as an integral part of said stationary main body.

23. The device of claim 14 wherein one of said blades has an abrasive bottom surface.

24. The device of claim 1 wherein said stationary main body is adapted to be mounted in a conventional strainer member of a household drain.

25. The device of claim 1 in combination with a conventional strainer portion of a household drain, wherein said conventional strainer portion includes a horizontal cross member and said spring rests on said cross member so as to be compressed between said movable size reduction assembly and said cross member when said movable size reduction assembly moves between said upper position and said lower position thereof.

26. The device of claim 1 wherein said stationary main body is adapted to replace a conventional drain strainer member.

27. The device of claim 26 wherein said stationary main body includes a radially extending flange.

28. The device of claim 1 wherein said strainer includes a perforated base plate and wherein said movable size reduction assembly includes a plurality of vertically extending members each having a lower end portion aligned with and movable into a respective opening defined in the bottom plate.

29. The device of claim 28 wherein said lower end portion of one of said vertically extending members includes a waste-gathering notch.

30. The device of claim 29 wherein said lower end portion of one of said vertically extending members has an abrasive surface.

31. The device of claim 1 including a latching mechanism operatively interposed between said movable size reduction assembly and said stationary main body so as to keep said movable size reduction assembly selectively in said lower position thereof, and including a seal member arranged to prevent liquid from flowing through said device when said movable size reduction assembly is in said lower position thereof.

32. The device of claim 31 wherein said strainer portion includes a bottom member of said stationary main body, the stationary main body including a centrally located portion extending upward from said bottom member, the movable size reduction assembly including a plurality of vertically oriented fingers, and said bottom member defining a plurality of apertures arranged to receive respective ones of said fingers.

33. The device of claim 32 in combination with a strainer member of a household drain, said strainer member including a radially extending upper flange, and said seal member being included in said movable size reduction assembly and movable into a position of contact against seal flange by moving said size reduction assembly to said lower position thereof.

34. The device of claim 1 wherein said strainer portion includes a bottom member of said stationary main body, the stationary main body including a centrally located portion extending upward from said bottom member, the movable size reduction assembly including a plurality of vertically oriented fingers, and said bottom member defining a plurality of apertures arranged to receive respective ones of said fingers.

35. The device of claim 1 in combination with a strainer member of a household drain, said strainer member including a radially extending upper flange, and said movable size reduction assembly including a sealing member movable into a position of contact against seal flange by moving said size reduction assembly to said lower position thereof.

36. A method for preventing waste materials from clogging a household drain, comprising:

(a) receiving a quantity of waste material contained in a flow of water toward a drain receptacle;

(b) guiding the flow of water containing waste materials to a predetermined position adjacent a part of a manually operable device mounted within the drain receptacle;

(c) gathering the quantity of the waste material from the flow of water in a first location adjacent a member of the manually operable device located in the drain receptacle using the flow of water to align the quantity of waste material in a predetermined arrangement within the device, including gathering and entwining a plurality of hairs included in said waste material;

(d) maintaining the flow of water to hold the waste material in the first location while manually moving a size reduction assembly portion of the device so as to grip a portion of the quantity of waste material;

(e) thereafter moving the size reduction assembly farther and thereby dividing the portion of the waste material into a plurality of smaller pieces; and (f) thereafter, carrying the smaller pieces away from said drain receptacle and through a drain conduit in the flow of water.

37. The method of claim 36 wherein, the predetermined arrangement includes arrangement of at least some of the waste materials into a strand.

38. The method of claim 37 including the step of using the flow of water to hold the strand of waste material in a location spanning a plurality of neighboring water passages through a containment portion of the device.

39. The method of claim 37 wherein the step of comminuting the waste material includes moving the size reduction assembly downward, thereby urging a plurality of notched fingers into contact with the strand and into respective ones of the water passages, thereby tearing the strand into small pieces.

40. The method of claim 36 including the step of mechanically carrying a portion of the waste material along an abrasive surface, thereby cutting some of said waste material into smaller pieces.

41. The method of claim 36 including the step of closing the drain by engaging the size reduction assembly with a part of the drain receptacle and thereby holding a sealing member carried on the size reduction assembly in sealing contact with a surface of the drain receptacle.

42. The method of claim 36 including the step of forming an elongate strand of said waste material by utilizing said flow of water to align a plurality of hairs alongside one another and urge said hairs toward a central portion of the device.

43. The method of claim 36 including gathering and entwining a plurality of hairs included in said waste materials as a part of the step of aligning the quantity of waste materials, and using the flow of water to align a strand of hairs transversely across the flow of water.

44. The method of claim 36 including the step of catching a piece of said waste material in an opening defined in said size reduction assembly and shearing the piece of waste material by cooperative action of the size reduction assembly and a stationary part of said device.

45. A method for preventing waste materials from clogging a household drain, comprising:

(a) receiving a quantity of waste material contained in a flow of water toward a drain receptacle;

(b) guiding the flow of water containing waste materials to a predetermined position adjacent a part of a manually operable device mounted within the drain receptacle;

(c) gathering the quantity of the waste material from the flow of water in a first location adjacent a member of the manually operable device located in the drain receptacle;

(d) gathering and aligning a plurality of hairs included in the quantity of waste material to form a strand;

(e) maintaining the flow of water to hold the waste material in the first location while manually moving a size reduction assembly portion of the device so as to grip a portion of the quantity of waste material;

(f) thereafter moving the size reduction assembly farther and thereby dividing the portion of the waste material into a plurality of smaller pieces; and (g) thereafter, carrying the smaller pieces away from said drain receptacle and through a drain conduit in the flow of water.

46. The method of claim 45 including the steps of gripping a plurality of parts of said strand of said waste material while pushing the plurality of parts of the strand simultaneously into a plurality of respective apertures, thereby shearing said waste material into smaller pieces.

47. The method of claim 45 including the steps of gripping said strand of said waste material at a plurality of locations along a length of the strand while pushing a plurality of parts of the strand into a plurality of respective apertures, thereby tearing said waste material into smaller pieces.

48. The method of claim 45 including the steps of simultaneously holding and pushing on a plurality of locations along a length of said strand of said waste material, thereby pushing said strand simultaneously into a plurality of neighboring apertures and thereby pulling and tearing said waste material into smaller pieces.

49. The method of claim 45 including the step of gripping said strand of waste material at a plurality of places along the strand and thereafter forcing respective parts of the strand simultaneously into apart-spaced openings in a bottom member of the manually operable device, thereby elongating the strand sufficiently to cause it to break into a plurality of shorter pieces.

* * * * *